United States Patent [19]

Ooka

[11] Patent Number: 5,066,200

[45] Date of Patent: Nov. 19, 1991

[54] DOUBLE CONTAINMENT PUMPING SYSTEM FOR PUMPING HAZARDOUS MATERIALS

[75] Inventor: Kazuo Ooka, Morton Grove Village, Ill.

[73] Assignee: Ansimag, Inc., Elk Grove Village, Ill.

[21] Appl. No.: 525,125

[22] Filed: May 17, 1990

[51] Int. Cl.[5] ..... F04B 49/02

[52] U.S. Cl. ..... 417/63; 417/420

[58] Field of Search ..... 417/420, 423.14, 423.11, 417/63

[56] References Cited

U.S. PATENT DOCUMENTS

| | | | |
|---|---|---|---|
| 3,195,467 | 7/1965 | Collet | 417/420 |
| 3,411,450 | 11/1968 | Clifton | 417/420 |
| 3,572,981 | 3/1971 | Pearson et al. | 417/420 X |
| 4,111,614 | 9/1978 | Martin et al. | 417/420 |

*Primary Examiner*—Leonard E. Smith
*Attorney, Agent, or Firm*—Wallenstein, Wagner & Hattis, Ltd.

[57] ABSTRACT

A motor-driven pump assembly for hazardous fluids is of the magnetically coupled type wherein drive power from an electric motor is conveyed to a pump drive shaft by rotary magnetic couplings, the pump housing have a containment shell sealed to the motor housing and extending over the interior magnetic drive structure of the coupling to act as a seal against escape of hazardous fluids. A coupling shroud sealingly encloses the driving portion of the magnetic coupling assembly, joining the pump housing at one end and the motor housing region around the motor drive shaft end at the other end to provide containment of hazardous liquids escaping past the containment shell. A sealed reservoir is provided for such fluids, the reservoir communicating with the coupling shroud through a passage. A sensor is provided which reacts to the presence of hazardous fluids in the reservoir to actuate a suitable warning system. In the preferred form of the invention, the reservoir is configured as a containment shroud completely sealingly enclosing the remainder of the motor housing.

8 Claims, 1 Drawing Sheet

DOUBLE CONTAINMENT PUMPING SYSTEM FOR PUMPING HAZARDOUS MATERIALS

TECHNICAL FIELD

The electrically driven pump art, and in particular pumps for pumping hazardous and/or corrosive materials.

BACKGROUND OF THE INVENTION

A great many motor driven pumps assemblies are known in the art for pumping hazardous or corrosive fluids. In particular, care must be taken in the design of the pump and in the design of the mechanism coupling its drive shaft to a motor to insure that such fluids do not leak into the exterior environment to produce a hazard to attendant personnel. This poses severe requirements on the corrosion resistance of pump materials, and in particular on the corrosion and wear resistance of pump drive shaft seals. One successful approach has been to provide the driven end of the pump drive shaft with a generally radially extending carrier structure rigidly affixed to the shaft end. Embedded within the carrier structure are a plurality of permanent magnets, typically in the form of elongated bars, having one of their major dimensions closely proximate to the external periphery of the carrier. The carrier is made of material not susceptible to attack by the fluid being pumped. The housing is in turn configured with a generally closely fitting cylindrical containment shell or shroud sealed at one end and closely confining the carrier, the shell being sealed at its other end to the housing.

Motor drive power is supplied through a similar magnet-carrying assembly having a generally cylindrical collar coaxially disposed with respect to, and extending over the containment shell and having a similar number of permanent magnets affixed to the interior surface thereof. Rotation of the outer magnet assembly will then cause the interior magnets to be drawn into rotation generally in synchronism with the speed of the drive motor. Such systems are well known in the art, and are shown, for example, in Oikawa U.S. Pat. No. 4,013,384, the contents of which are incorporated by reference herein. A principal problem with such structures is that the containment. shell, which must necessarily have relatively thin outer walls to keep the intermagnet spacing at a minimum may on occasion crack, resulting in hazardous leakage. To the applicant's knowledge there has not been a satisfactory solution to this problem to date.

The teachings of the present invention are oriented towards a solution of this problem.

SUMMARY OF THE INVENTION

According to a feature of the invention a motor-driven pump system of the type previously described, i.e., having a containment shell sealingly surrounding a magnetic drive assembly affixed to one end of a pump shaft, has a coupling shroud sealingly affixed to the pump housing and extending generally coaxially over the magnetic driving assembly and sealed to the end of a motor assembly housing to sealingly enclose the end of the motor drive shaft coupled to the outer magnetic assembly. A sealed reservoir is provided communicating through one or more passage ways with the interior of the coupling shroud to collect hazardous fluids escaping past the containment shell therein.

According to a related feature of the invention, the reservoir is configured as a shroud sealingly containing the remainder of the motor housing, and having one or more passages a low point therein and communicating with the coupling shroud. Thus, even if hazardous fluids should leak interior of the motor housing through the motor draft shaft seal, full containment of such fluids is achieved. Sensing means taking a variety of forms, and in particular taking the form of an electrical probe system, are provided which will provide a warning condition when the collected fluid contacts the probe. Alternatively a pressure sensor is employed.

Other advantages and aspects of the invention will become apparent upon making reference to the specification, claims, and drawings to follow.

DESCRIPTION OF THE INVENTION

Figure 1:
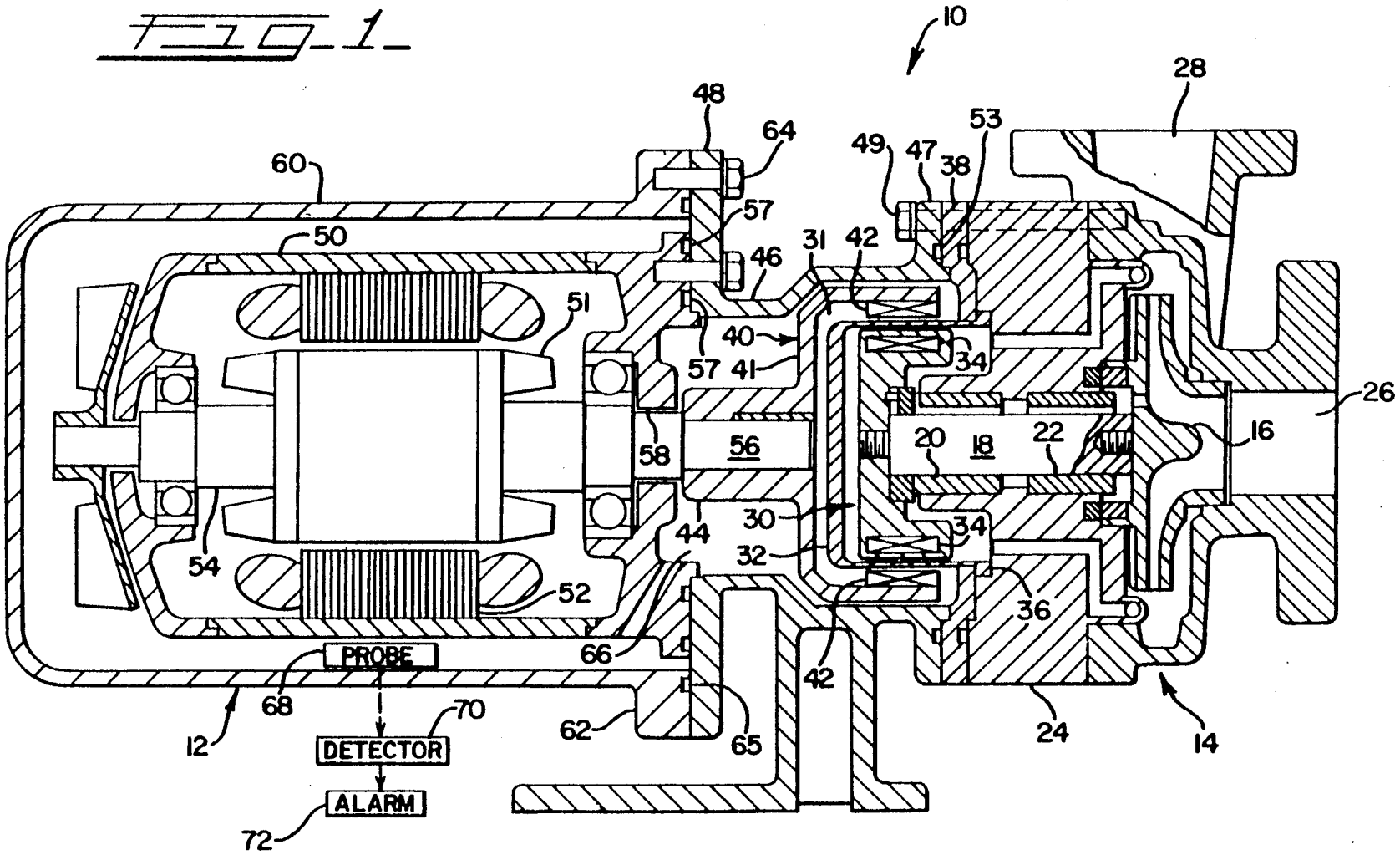
FIG. 1 is a partially cutaway view of an electrically driven pump assembly having electric motor mounted to drive an impeller-type pump.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Referring now to FIG. 1, there is shown therein a motor-driven pump system 10 comprising a motor assembly 12 mounted to a pump assembly 14. The pump assembly 14 comprises an impeller 16 rigidly affixed to a pump drive shaft 18 mounted on bearings 20, 22, the bearings in turn being secured to a pump housing 24. An inlet port 26 is generally axially disposed to admit fluid to the impeller 16 and ejection occurs through outlet port 28. Affixed to the opposite end of the pump drive shaft 18 is a magnetic assembly comprising a radially extending carrier 30 having a plurality of magnets 34-34, the carrier completely enclosing the magnets so as to prevent their being attacked by corrosive fluids.

The region of the housing 24 in the vicinity of the carrier 32 is sealed by a containment shell 31 (wall sealing means) configured as a cylindrical shell sealed at its outer end and having an annular projection 36 compressingly sealed against the housing face 24 by a compression flange 38. The entire interior of the pump assembly is thus secured in principle against leakage of hazardous fluids. Drive power is secured by rotation of a drive magnet assembly 40 configured as a carrier sleeve 41 carrying interior drive magnets 42 emplaced to lie in a generally confronting relationship with the magnets 34. A radial collar 44 extends from the carrier 41 to be engaged by motor drive means.

A generally cylindrical coupling shroud 46 (first shroud means) is sealingly affixed to the pump housing 24 by a terminal flange portion 47 sealingly engaged to the flange 38 by bolts 49, the sealing being secured by an O-ring seal 53. The shroud 46 extends beyond the outer dimension of the carrier 41 and is provided with a terminal radially outwardly extending flange 48. A motor housing 50 is sealingly mounted to the other side of flange 48 by O-ring seals 57-57. A motor 49 disposed within the motor housing 50 has a motor stator 52 surrounding a motor rotor 51 rigidly affixed to a drive shaft 54 having one end thereof 56 extending from the housing through a shaft seal 58. It will be noted that the interior of the coupling shroud 46 is thus sealed so as, in principle, to prevent any fluid leaking past the containment shell 31 from escaping into the exterior environment. A second generally cylindrical containment shroud 60 (reservoir means), sealed at one end, is emplaced around the motor housing 50, and is provided at its open end with a flange 62 abutting the coupling flange 48 and compressingly sealed thereto by means of bolts 64 and an O-ring seal 65. The containment shroud 60 thus sealingly surrounds the remainder of the motor housing 50.

At least one passage 66 is provided passing through the base of the motor housing 50 to provide communication between the interior of the containment shroud 60 and the coupling shroud 46. The passage 66 is oriented to be at a low point in the motor-driven pump system 10, so that any corrosive fluids escaping past the containment shell 31 will flow through the passage to be trappingly contained within the containment shroud 60.

A sensing probe 68, symbolically shown in the drawings, is disposed within the lower portion of the containment shroud 60 to provide electrical signal condition indicative of the presence of the corrosive or hazardous fluid in the containment shroud 60. This probe may take a variety of forms, depending upon the nature of the hazardous fluid being pumped. Since many hazardous fluids, and virtually all corrosive fluids, tend to have a high ionic content, and thus a significant electrical conductivity, the sensing probe 68 may typically take the form of a pair of spaced-apart electrical contacts (not shown) having electrical connectors (not shown) passing through the lower wall of the shroud 60. The presence of the liquid phase in contact with the probe 68 then establishes a conducting condition therebetween, to be detected by a detector 70 responsively coupled to the probe 68. The detector 70 which may sound an appropriate alarm 72, may also be employed to automatically shut down electrical power to the motor assembly 12. Alternatively, the sensing probe 68 may take the form of a pressure sensor disposed within or in communication with the interior of the containment shroud 60, and may include a visible display of one form or another indicative of the pressure build-up within the containment shroud. Additionally, detector 70 may be configured to react to closure of a pressure-sensitive switch associated with the sensing probe 68 to similarly actuate an alarm 72. Thus, in either system ample warning is given to exposed personnel that a potentially hazardous situation exists requiring corrective measures.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

I claim:

1. A containment system for a motor-driven pump assembly having rotary pump means including a pump housing, a pump drive shaft, inlet and outlet port means, rotary motor means including motor housing means having a motor drive shaft end extending through a face of said motor housing means, and coupling means for coupling said motor drive shaft to said pump drive shaft, said containment system comprising:

first shroud means extending between said motor housing means face and said pump housing and sealingly affixed to said motor housing means face and said pump housing to enclose said motor drive shaft end and said coupling means;

sealed reservoir means for storing fluid; and passage means communicating between the interior of said first shroud means and the interior of said reservoir means for permitting the flow of fluids escaping past said sealing wall means to be stored in said reservoir means.

2. A motor-driven pump assembly comprising:

rotary pump means including a pump housing, a pump drive shaft, inlet and outlet port means, first magnetic coupling means affixed to one end of said pump drive shaft, sealing wall means sealingly affixed to said housing and configured to enclose said first magnetic coupling means, second magnetic coupling means for magnetically coupling drive torque to said first magnetic coupling means through said sealing wall means so that rotation of said second magnetic coupling means rotates said first magnetic coupling means to drive said pump drive shaft;

rotary motor means including motor housing means having a motor drive shaft end extending through a face of said motor housing means and connected to drivingly rotate said second magnetic coupling means;

first shroud means extending between said motor housing means face and said pump housing and sealingly affixed to said motor housing means face and said pump housing to enclose said motor drive shaft end and said second magnetic coupling means;

sealed reservoir means for storing fluid; and passage means communicating between the interior of said first shroud means and the interior of said reservoir means for permitting the flow of fluids escaping past said sealing wall means to be stored in said reservoir means.

3. The pump assembly of claim 1 wherein said pump means is centrifugal pump means.

4. The pump assembly of claim 1 wherein said reservoir means is configured as second shroud means for sealingly enclosing the remainder of said motor housing means.

5. The pump assembly of claim 2 wherein first shroud means includes a radially extending face sealingly affixed to a flange-forming plate having said motor housing means face and second shroud means.

6. The pump assembly of claim 1 including sensing means for detecting the presence of escaped fluids inside said reservoir means.

7. The pump assembly of claim 6 wherein said sensing means includes electrical probe means disposed to contact fluid collected within said reservoir means and electrical circuit means connectable to said probe means for providing a warning electrical signal condition responsively to such contact.

8. The pump assembly of claim 6 wherein said sensing means includes pressure sensing means for sensing pressure buildup within said reservoir means.

* * * * *